US007302736B2

(12) United States Patent
Lawler

(10) Patent No.: US 7,302,736 B2
(45) Date of Patent: Dec. 4, 2007

(54) WINDOW EGRESS ASSISTANCE HANDLE

(75) Inventor: Gregory Lawler, 723 Hawk La., Coppell, TX (US) 75019

(73) Assignee: Gregory Lawler, Coppell, TX (US)

( * ) Notice: Subject to any disclaimer, the term of this patent is extended or adjusted under 35 U.S.C. 154(b) by 0 days.

(21) Appl. No.: 11/047,978

(22) Filed: Feb. 1, 2005

(65) Prior Publication Data

US 2005/0166367 A1 Aug. 4, 2005

Related U.S. Application Data

(60) Provisional application No. 60/541,106, filed on Feb. 2, 2004.

(51) Int. Cl.
*E05B 1/00* (2006.01)

(52) U.S. Cl. ..... 16/444; 16/443; 16/426; 16/422

(58) Field of Classification Search ..... 16/444, 16/422, 426, 413, 419, 443, 416, 424, 425; 248/208; 294/57, 58; 49/460, 480
See application file for complete search history.

(56) References Cited

U.S. PATENT DOCUMENTS 2,601,476 A * 6/1952 Weatherstone ..... 49/429
4,541,443 A * 9/1985 Brothers et al. ..... 132/75.6
4,788,745 A * 12/1988 Wallis et al. ..... 16/413
4,846,518 A * 7/1989 Hamel ..... 294/99.1
4,922,576 A * 5/1990 Weidner et al. ..... 16/413
5,127,131 A * 7/1992 Corrigan et al. ..... 16/422
5,460,461 A * 10/1995 McGrath ..... 404/118
5,645,305 A * 7/1997 Lispi ..... 294/58
5,890,261 A * 4/1999 Mantarakis ..... 16/413
6,363,926 B1 * 4/2002 Stephen et al. ..... 126/41 R
6,571,505 B1 * 6/2003 Poiencot, Jr. ..... 43/5
6,644,702 B2 * 11/2003 Liou ..... 294/57
6,728,994 B1 * 5/2004 Rushin et al. ..... 16/426
7,028,374 B2 * 4/2006 Fiocco ..... 16/422
2003/0217437 A1 * 11/2003 Chen ..... 16/422

* cited by examiner

*Primary Examiner*—Katherine Mitchell
*Assistant Examiner*—Michael J. Kyle

(57) ABSTRACT

A window egress assistance handle having a base, at least one finger grip with two legs, multiple offset orifice fixation ports for receiving multiple securing devices such as set screws or thumb screws, and a base midline grooved channel receiver. To temporarily install and use the handle, the handle is positioned to envelope an integrated extruded window sash lift in the grooved channel receiver, and the securing devices disposed in the multiple offset fixation port are engaged to create a binding compressive force upon enveloped sash lift. The window can then be lifted or slid by applying force to the finger grips. The handle can be adjusted to the user's strength, size, and dimensions, and installed and removed without use of tools or creating permanent damage to the framework of the window.

8 Claims, 3 Drawing Sheets

WINDOW EGRESS ASSISTANCE HANDLE

CROSS-REFERENCE TO RELATED APPLICATIONS

Priority is claimed for this patent application to U.S. Provisional Patent Application No. 60,541,106, filed Feb. 2, 2004, by Gregory Lawler.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

U.S. Provisional Patent Application No. 60,541,106, is hereby incorporated by reference in its entirety, including figures.

BACKGROUND OF THE INVENTION

1. Field of the Invention

This invention relates to window opening assistance devices for anyone needing assistance opening a window, especially in emergency situations.

2. Background of the Invention

Windows in dwellings can become difficult to open. This is due to post construction changes in a structure. Changes that frequently occur are shrinking and swelling of the window unit due to exposure of extreme elements of weather such as heat, cold, dry or moist atmospheres. Over time many structures may experience shifting due to ground movement and gravity. Dirt deposits collect due to poor maintenance. These post construction changes can cause the window to become difficult to open.

Many windows integrate a dedicated lift area. However, many times this area is not sufficient regarding the size and strength of the occupant desiring to open the window.

This clearly puts occupants at great disadvantage when needing to make emergency exit. This is evident by the fact that there are 2 ways out of a home in the event of fires. Yet 800 kids under the age of 9 die each year in home fires. The problem of window egress is clear and can be addressed properly by the use of my invention. Proper education and encouragement by professional and volunteer firefighters are only available after engineering process is complete. Our invention must be first available.

It is estimated by the firefighting profession that 60-90% of home dwellers do not practice fire drills. To highlight the importance of our invention could save many lives. After Sep. 11, 2001, the Department of Homeland Security cited that terrorists could threaten soft targets. This included family dwellings. As firefighters, we have a response obligation of duty to protect America from harm at every level concerning safety. The most important problem our invention will solve is allowing us as firefighters to give kids a solid answer to their most common question, which is "What do I do if the window will not open during a fire and that is my only way out?". Today, firefighters across the country answer "Do whatever it takes." This is not a good plan.

Window lift areas are usually integrated into the framework of the window by manufacturers. Historically, these areas are small and present a challenge to the fingertip strengths of many users, especially the young and others who have dexterity deficits. Additional handles may be obtained when minimal or no integrated lift design exists. These additional handles require skill to ensure proper mounting. These additional handles are usually screwed into the framework and the margin for error by the untrained installer can range from crooked handles to unrepairable holes in the framework of the window. Placement errors can cause the handle to become less effective. Placement issues are of great importance to the end user. These additional handles do not allow movement or adjustment to meet the optimum position for the user whose needs may change, without leaving unsightly holes when removing the additional handle to move or adjust it. Optimum leverage is desired during the lifting, pushing, or pulling action during sliding operation in accordance with the physical changes of the user. If people of different sizes change living quarters, it requires possible different position placement of these additional handles in order to optimize leverage. Additionally, when one moves from one dwelling to another, to remove these additional handles leaves unsightly holes in the window framework.

SUMMARY OF THE INVENTION

My invention is a combination handle and window sash lift system. The combination handle and window sash lift system provides greater surface area for grasping, pushing, pulling and lifting, thereby allowing the user to leverage any additional available strength for the purpose of assistance in the opening and closing operation of the window.

BRIEF DESCRIPTION OF THE DRAWINGS

The present embodiment should be more fully understood when the written description is considered in conjunction with the drawings contained herein, wherein.

has an integrated extruded sash lift (8) which shows two window egress assistance handles (1) attached.

Figure 5:
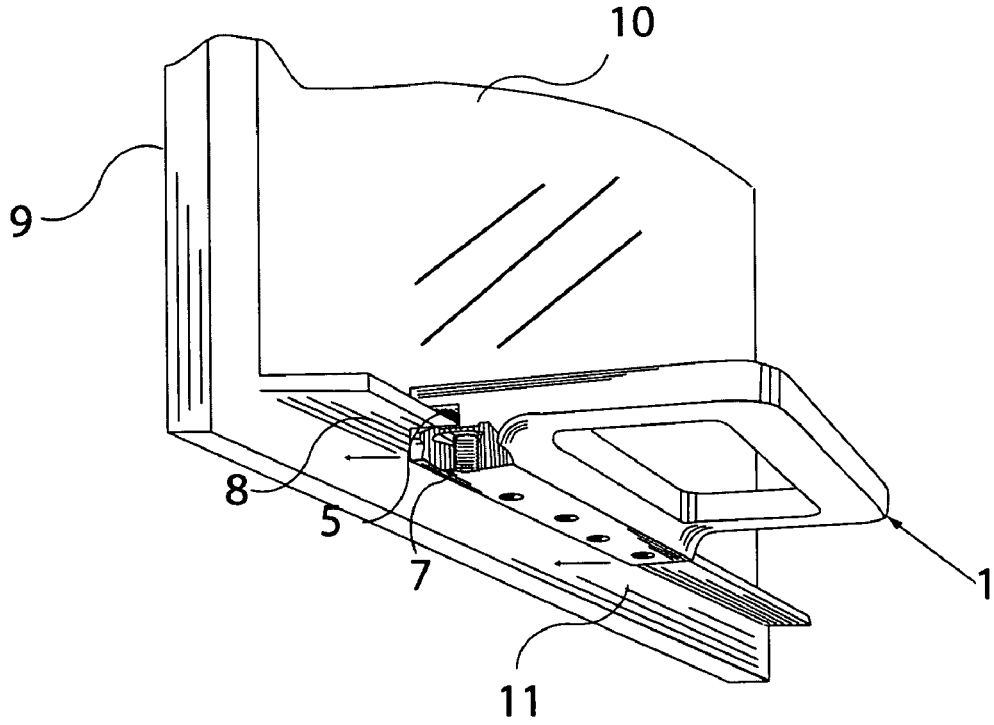

FIG. 5 shows a partial view of a window stile (9), window glass pane (10), and a bottom rail (11). A bottom view of the cutaway window egress assistance handle (1) positioned with the base midline groove (5) enveloping the integrated extruded window sash lift (8) temporarily secured by set screws (7).

Figure 6:
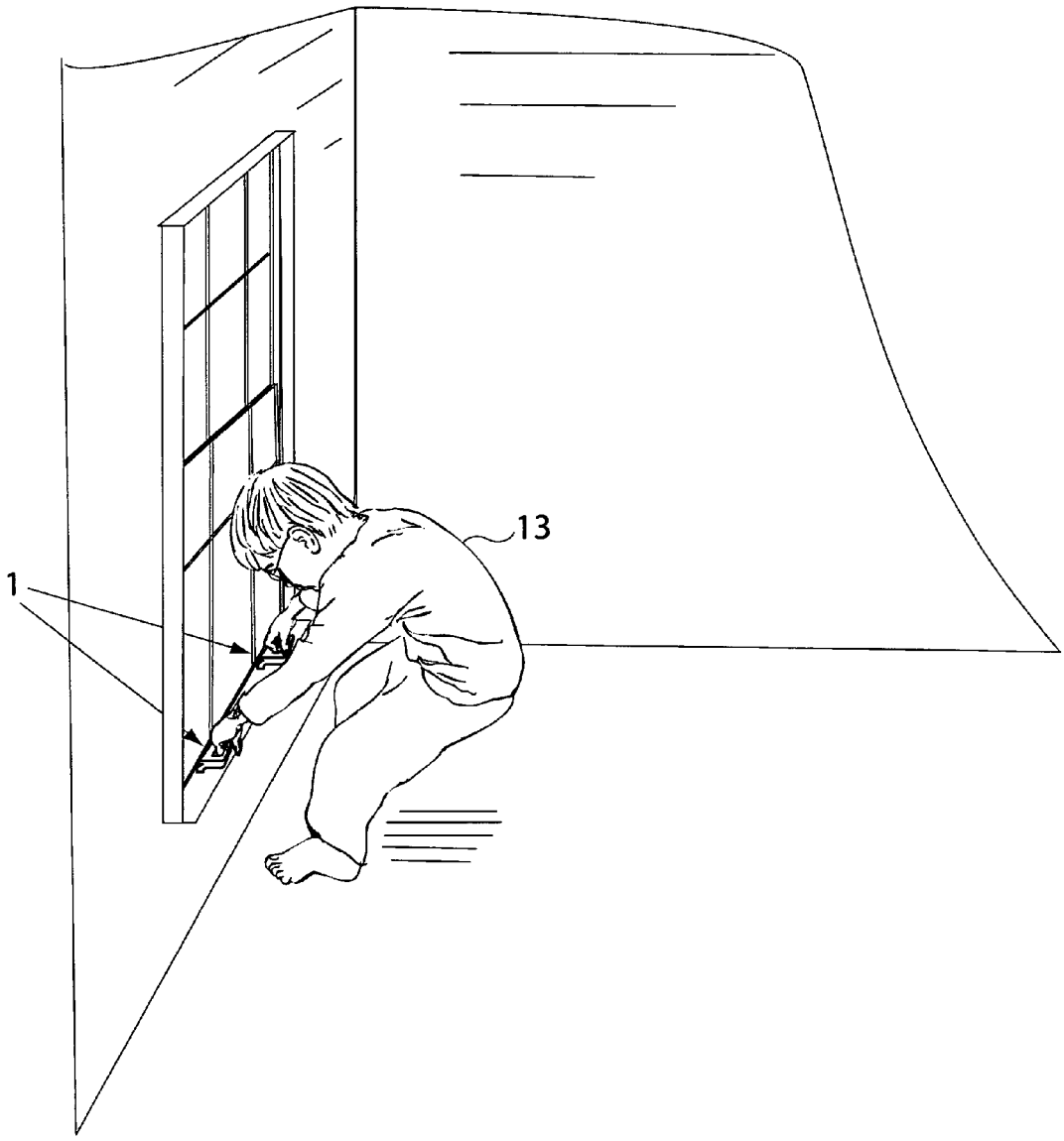

FIG. 6 shows a person (13) using the window egress assistance handles (1) after mounting.

DETAILED DESCRIPTION OF THE INVENTION

Figure 1:
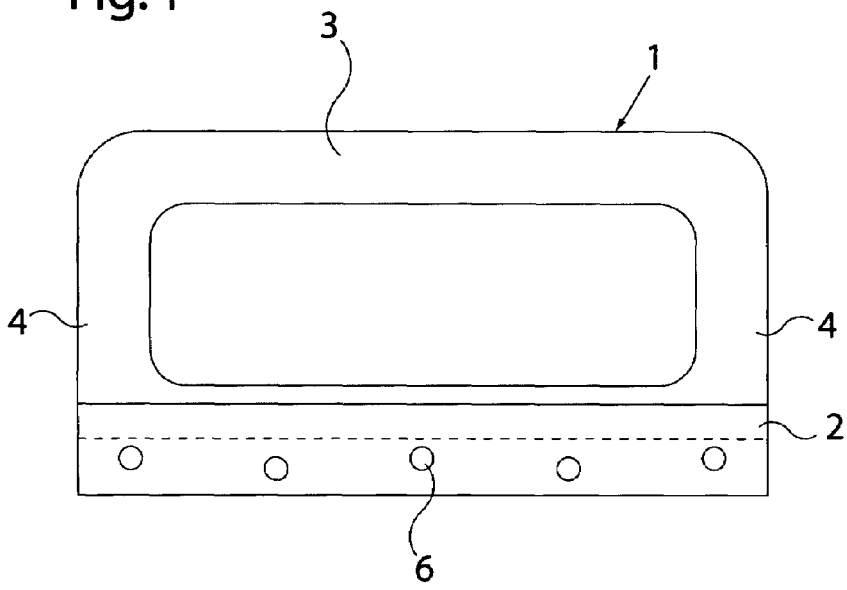
FIG. 1 shows a bottom view of the entire window egress assistance handle (1)with a base (2), which is divided into two members which are equidistant and parallel to each other; that bound a base midline groove, the bottom base member is offset bridged by a radius and parallel to at least one finger grip (3), the top member is flush and on the same plain parallel with finger grip, with two legs (4); at least three staggered orifice threaded fixation ports extend perpendicularly through the offset base member for receiving at least three various securing devices with each port receiving one securing device(6).
Figure 2:
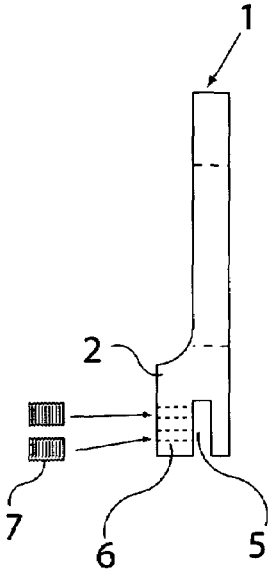
FIG. 2 shows a side view of the window egress assistance handle (1) with a base (2), which is divided into two members which are equidistant and parallel to each other; that bound a base midline groove, the base midline groove (5), at least three staggered orifice threaded fixation ports for at least three various securing devices with each port receiving one securing device(6) with set screws (7).
Figure 3:
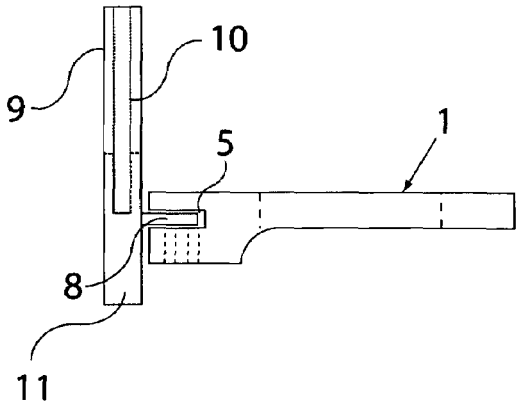
FIG. 3 provides a side view of the combination handle and window sash lift system (1) positioned for attachment by placing the base midline groove (5) as to envelope the integrated extruded window sash lift (8) that is part of the bottom rail (11) which is attached to a side window stile (9) which holds the window pane glass (10).
Figure 4:
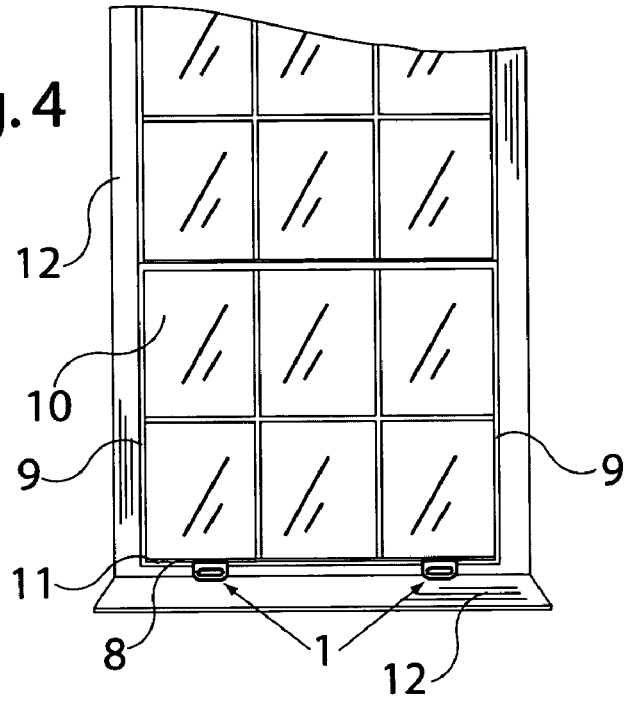
FIG. 4 includes a window frame (12) showing window stiles (9) with a bottom rail (11) and a top rail (not shown) that houses a windowpane glass (10). The bottom rail(11)

As shown in FIG. 1, a window egress assistance handle (1) made of metal, which also could be made as a unitary piece of resilient material comprised of two pieces fastened together to form a compressive friction fit binding both surfaces of the sash lift. The handle includes a base (2) which is divided into two members which are equidistant and parallel to each other; that bound a base midline groove, the bottom base member is offset bridged by a radius and parallel to at least one finger grip(3) the top member is flush and on the same plain parallel with finger grip, with two legs (4); at least three staggered orifice threaded fixation ports extend perpendicularly through the offset base member for receiving at least three various securing devices with each port receiving one securing device(6) such as set screws or thumb screws (7) engaged to create a non-penetrating binding compressive friction fit. The based midline groove (5) is shown throughout FIG. 2 and FIG. 3. A window stile (9) with window pane glass (10) and a bottom rail (11) with and integrated extruded window sash lift (8) that receives the window egress assistance handle (1) by enveloping the base midline groove (5). Two handles (1) are temporarily mounted on an integrated extruded window sash lift (8) as shown in FIG. 4. FIG. 5 is a bottom view of FIG. 3. FIG. 6 shows a person (13) using the handle and window sash lift system (1) after mounting.

To use the handle and window sash lift system invention, locate the subject window upper or lower sash lift for vertical windows. The device is mounted by placing the base midline groove (5) into position as to envelope the extruded window sash lift (8) which is then held securely in place temporarily by the use of at least three set screws (7) one set screw is placed in each staggered orifice threaded fixation port(6). The handle and window sash lift system, when used in vertical operations should be mounted equidistant from the ends of the window and inline with the user's shoulders.

To use the handle and window sash lift system (1) invention, locate the extruded window sash lift (8) on either the left or right side for horizontal windows. The device is mounted by placing the base midline groove (5) into the position as to envelope the extruded window sash lift (8) which is then held securely in place temporarily by the use of at least three set screw, one set screw is placed in each staggered orifice threaded fixation port(6). The handle and window sash lift system (1) when used in the horizontal operation should be mounted four inches above the interior sill or even with the user's shoulder while standing.

The handle and window sash lift system (1) assists the user in opening the window after the window is unlocked. The user grasps the handle and window sash lift system (1) and lifts, pushes or pulls. The handle and window sash lift system (1) provides greater surface area for grasping, allowing the user to leverage any additional available strength for the purpose of assistance in the opening and closing operation of the window, especially in emergent situations. A combination handle and window sash lift system having a base, which is divided into two members which are equidistant and parallel to each other; that bound a base midline groove, the bottom base member is offset bridged by a radius and parallel to at least one finger grip the top member is flush and on the same plain parallel with finger grip, with two legs; at least three staggered orifice threaded fixation ports extend perpendicularly through the offset base member for receiving at least three various securing devices such as set screws or thumb screws, and the base midline groove. To temporarily install and use the handle, the handle is positioned to envelope an integrated extruded window sash lift in the base midline groove, and at least three various securing devices disposed in at least three staggered orifice threaded fixation ports are engaged to create a binding compressive friction fit upon sash lift. The window can then be lifted or slid by applying force to the finger grips. The handle can be adjusted and positioned to the user's size. The handle can be installed and removed without the use of tools or creating permanent damage to the framework of the window.

What is claimed is:

1. A combination handle and window sash lift system comprising: a base (2) which is divided into top and bottom members which are equidistant and parallel to each other; that bound a base midline groove, the bottom base member is offset and parallel to at least one finger grip (3) the top member is flush and has a top surface coplanar with a top surface of said finger grip with two legs (4) extending between the finger grip and top member; at least three staggered orifice threaded fixation ports extend perpendicularly through the bottom base member, each receiving a respective securing device; said base midline groove (5) envelopes an extruded window sash lift (8) portion extending in a plane intersecting a plane of the window sash; said securing devices (7) disposed singularly in each said at lent three staggered orifice threaded fixation ports (6), engaged to create a non-penetrating binding compressive friction fit upon said enveloped extruded window sash lift portion, thereby temporarily mounting said handle to said extruded window sash lift portion.

2. The device as set forth in claim 1 wherein said base is comprised of metal.

3. The device a set forth in claim 1 wherein said base is comprised of a unitary piece of resilient material.

4. The device as set forth in claim 1 wherein said base is comprised of two pieces of resilient material fastened perpendicularly together to form a non-penetrating compressive friction fit binding both surfaces of the sash lift.

5. The device as set forth in claim 1 wherein said securing devices extend perpendicularly through one of the base members comprise at least three set screws.

6. The device as set forth in claim 1 wherein said securing devices extend perpendicularly through one of the base members comprise at least three thumb screws.

7. The device as set forth in claim 1 wherein said finger grip and legs comprise a singular unitary piece.

8. The device as set forth in claim 1 wherein said base is comprised of a bottom member offset bridged by a radius.

* * * * *